US009770897B2

(12) United States Patent
Abe et al.

(10) Patent No.: US 9,770,897 B2
(45) Date of Patent: Sep. 26, 2017

(54) TRANSPORTATION APPARATUS, PRINTING APPARATUS, AND TRANSPORTATION AMOUNT ACQUISITION METHOD

(71) Applicant: SEIKO EPSON CORPORATION, Tokyo (JP)

(72) Inventors: Takahiro Abe, Shiojiri (JP); Tomoya Murotani, Shiojiri (JP); Hiroyuki Kobayashi, Shimosuwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/162,327

(22) Filed: May 23, 2016

(65) Prior Publication Data

US 2016/0347087 A1 Dec. 1, 2016

(30) Foreign Application Priority Data

May 25, 2015 (JP) ..... 2015-105429

(51) Int. Cl.

| | |
|---|---|
| ***B65H 7/00*** | (2006.01) |
| ***B41J 2/01*** | (2006.01) |
| ***B41J 11/00*** | (2006.01) |
| ***B41J 13/00*** | (2006.01) |

(52) U.S. Cl.

CPC ..... *B41J 2/01* (2013.01); *B41J 11/0095* (2013.01); *B41J 13/0027* (2013.01); *B65H 7/00* (2013.01)

(58) Field of Classification Search

CPC . B41J 11/00; B41J 11/007; B41J 5/048; B41J 5/046; B41J 2/01; B65H 5/06; B65H 7/14; B65H 2301/331; B65H 2511/242; G03G 2215/00156; G03G 2215/00139; G03G 2215/00143; G03G 2215/00223

See application file for complete search history.

(56) References Cited

U.S. PATENT DOCUMENTS

2006/0197038 A1* 9/2006 Park ..... G01N 21/86 250/559.37
2009/0323094 A1* 12/2009 Hayashi ..... B41J 11/0095 358/1.12

FOREIGN PATENT DOCUMENTS

JP 2013-075489 4/2013
JP 2013-241249 12/2013

* cited by examiner

*Primary Examiner* — Sharon A Polk
(74) *Attorney, Agent, or Firm* — Workman Nydegger

(57) ABSTRACT

A transportation apparatus includes a transportation section that transports continuous paper in a transportation direction intersecting with a shaft direction of a transportation roller. An imaging section includes plural photoreceptor elements and captures an image of the continuous paper transported by the transportation section. The photoreceptor elements are arranged in a first direction and a second direction, the first direction intersecting with the shaft direction, and the second direction intersecting with the first direction. A transportation amount acquisition section acquires a transportation amount of the continuous paper in the transportation direction on the basis of the image captured by the imaging section. The transportation amount acquisition section acquires the transportation amount of the continuous paper by correcting a movement amount of the continuous paper in the first direction with a correction value that changes in accordance with orientation of the first direction.

7 Claims, 5 Drawing Sheets

TRANSPORTATION APPARATUS, PRINTING APPARATUS, AND TRANSPORTATION AMOUNT ACQUISITION METHOD

BACKGROUND

1. Technical Field

The present invention relates to a transportation apparatus, a printing apparatus equipped with the transportation apparatus, and a transportation amount acquisition method.

2. Related Art

A paper transportation mechanism (transportation device) that transports paper (medium) by rotation of a driving roller is known (for example, see JP-A-2013-241249). The paper transportation mechanism detects the rotation amount of the driving roller by using a rotary encoder, and detects the actual feed amount of paper by using a photoreceptor unit (imaging unit) that receives light reflected by the paper. Then, the slip of the paper on the driving roller is detected by comparing the rotation amount of the driving roller with the feed amount of the paper.

In some cases, a photoreceptor unit is mounted in an inclined state due to the tolerance of parts or a mounting error. Therefore, there is a risk of a discrepancy between the actual feed amount of paper and the feed amount detected on the basis of light received by the photoreceptor unit.

SUMMARY

An advantage of some aspects of the invention is to provide a transportation apparatus that is capable of acquiring the transportation amount of a transported medium precisely, a printing apparatus equipped with the transportation apparatus, and a transportation amount acquisition method.

Solving means according to some aspects, and operational effects thereof, are described below.

A transportation apparatus according to some aspects comprises: a transportation section that transports a medium in a transportation direction intersecting with a shaft direction of a driving roller by operating the driving roller; an imaging section that includes a plurality of light-receiving elements and captures an image of the medium transported by the transportation section, the light-receiving elements being arranged in a first direction and a second direction, the first direction intersecting with the shaft direction, the second direction intersecting with the first direction; and a transportation amount acquisition section that acquires a transportation amount of the medium in the transportation direction on the basis of the image captured by the imaging section, wherein the transportation amount acquisition section acquires the transportation amount of the medium by correcting a movement amount of the medium in the first direction with a correction value that changes in accordance with orientation of the first direction.

With this structure, it is possible to acquire the movement amount of the medium in the first direction on the basis of the image of the medium captured by the imaging section. Then, it is possible to acquire the transportation amount of the medium in the transportation direction by correcting the movement amount with the correction value. Therefore, even in a case where the first direction and the transportation direction do not coincide with each other, it is possible to acquire the transportation amount of the transported medium precisely.

In the transportation apparatus described above, preferably, the correction value should be $1/\cos\beta$ when an angle formed by the transportation direction and the first direction is defined as $\beta$, and the transportation amount acquisition section should acquire, as the transportation amount of the medium, an amount obtained by multiplying the movement amount of the medium in the first direction by the correction value.

With this structure, it is possible to set the correction value in accordance with the angle $\beta$, which is formed by the first direction in which the light-receiving elements are arranged and the transportation direction in which the medium is transported. Then, on the basis of the correction value, it is possible to acquire the transportation amount easily.

In the transportation apparatus described above, preferably, the correction value should be $1/\sin\alpha$ when an angle formed by the shaft direction and the first direction is defined as $\alpha$, and the transportation amount acquisition section should acquire, as the transportation amount of the medium, an amount obtained by multiplying the movement amount of the medium in the first direction by the correction value.

With this structure, it is possible to set the correction value in accordance with the angle $\alpha$, which is formed by the first direction in which the light-receiving elements are arranged and the shaft direction of the driving roller. Then, on the basis of the correction value, it is possible to acquire the transportation amount easily.

In the transportation apparatus described above, preferably, when an angle formed by a first plane that includes the shaft direction and the transportation direction and a second plane that includes the first direction and the second direction is defined as $\gamma$, the transportation amount acquisition section should acquire, as the transportation amount of the medium, an amount obtained by multiplying the movement amount of the medium in the first direction by $\cos\gamma$.

With this structure, it is possible to acquire the transportation amount of the medium with the use of $\gamma$, that is, the angle formed by the first plane, along which the medium passes, and the second plane, on which the light-receiving elements are arranged. Therefore, even in a case where the first plane and the second plane are not in parallel with each other, it is possible to acquire the transportation amount of the transported medium precisely.

A printing apparatus according to some aspects comprises: the transportation apparatus having the structure described above; and a printing section that performs printing on the medium transported by the transportation apparatus. With this structure, the transportation apparatus can transport the medium on the basis of the transportation amount acquired with high precision. This makes it possible to improve the quality of printing on the medium transported by the transportation apparatus.

A transportation amount acquisition method according to some aspects is a method for a transportation apparatus that includes a transportation section and an imaging section, the transportation section transporting a medium in a transportation direction intersecting with a shaft direction of a driving roller by operating the driving roller, the imaging section including a plurality of light-receiving elements and capturing an image of the medium transported by the transportation section, the light-receiving elements being arranged in a first direction and a second direction, the first direction intersecting with the shaft direction, the second direction intersecting with the first direction, comprising: movement amount acquisition, in which a movement amount of the medium in the first direction is acquired on the basis of the image captured by the imaging section; and transportation amount acquisition, in which a transportation amount of the medium in the transportation direction is acquired by correcting the movement amount with a correction value that changes in accordance with orientation of the first direction.

With this method, the same effects as those of the transportation apparatus described above can be expected.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

With reference to the accompanying drawings, a printing apparatus according to a first embodiment will now be explained. A printing apparatus according to the present embodiment is, for example, an ink-jet printer that performs printing by ejecting ink, which is an example of liquid, onto a medium. The printer is a so-called serial printer that performs printing while moving a printing unit in a direction that intersects with a medium transportation direction.

Figure 1:
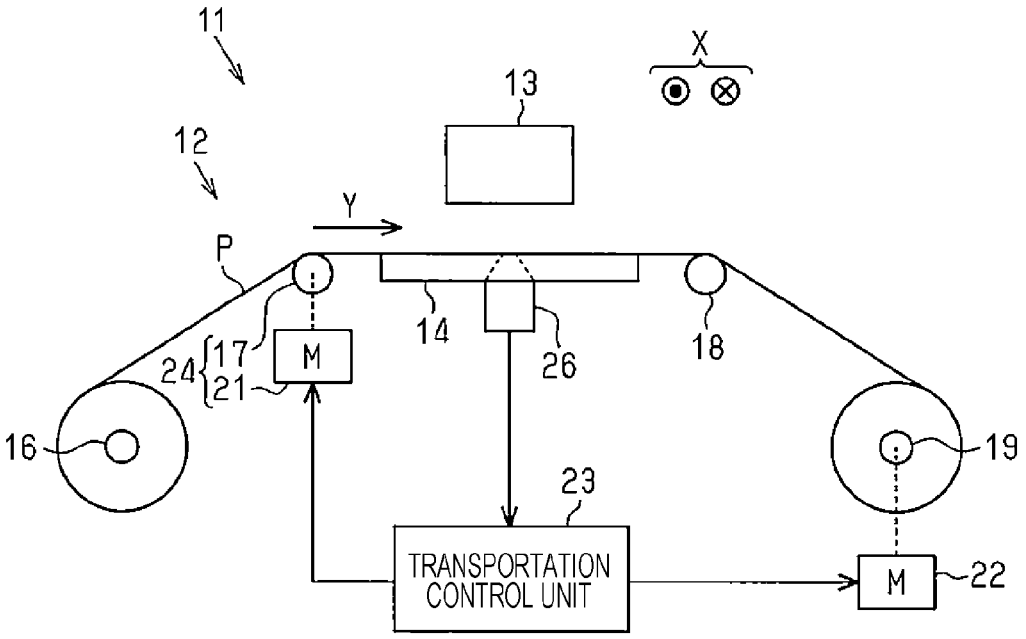
FIG. 1 is a schematic diagram of a printing apparatus according to a first embodiment.

As illustrated in FIG. 1, a printer 11 includes a transportation device 12, which transports continuous paper P, more specifically, elongated roll-sheet-type paper, and a printing unit 13, which performs printing on the continuous paper P transported by the transportation device 12. The continuous paper P is an example of a medium.

The transportation device 12 includes a supporting member 14, which supports the continuous paper P. The supporting member 14 is provided at a position where it faces the printing unit 13, with the transportation path of the continuous paper P going therebetween. The transportation device 12 further includes an unreeling shaft 16, a transportation roller 17, a relay roller 18, and a reeling shaft 19 in this order as viewed from the upstream side (left side in FIG. 1) in the transportation direction Y of the continuous paper P. The transportation roller 17 is an example of a driving roller. Namely, the unreeling shaft 16 and the transportation roller 17 are provided upstream of the supporting member 14 in the transportation direction Y, and the relay roller 18 and the reeling shaft 19 are provided downstream of the supporting member 14 in the transportation direction Y. The unreeling shaft 16, the transportation roller 17, the relay roller 18, and the reeling shaft 19 are rotatably supported substantially in parallel with one another in a state in which the shaft direction X of each of them intersects with (for example, is orthogonal to) the transportation direction Y.

The transportation device 12 further includes a transportation motor 21, which causes the transportation roller 17 to rotate, and a reeling motor 22, which causes the reeling shaft 19 to rotate. The transportation device 12 further includes a transportation control unit 23, which drives the transportation motor 21 and the reeling motor 22 and controls the transportation of the continuous paper P. In the present embodiment, the transportation motor 21, which is the driver of the transportation roller 17, and the transportation roller 17 make up a transportation unit 24, which transports the continuous paper P in the transportation direction Y.

The continuous paper P is supported in the form of a roll rotatably on the unreeling shaft 16. The continuous paper P unreeled is stretched on the transportation roller 17 and the relay roller 18 with a tension so as to be reeled onto the reeling shaft 19 at the downstream end of the continuous paper P in the transportation direction Y. Therefore, when the transportation motor 21 and the reeling motor 22 are driven, the continuous paper P is transported from the upstream side to the downstream side in the transportation direction Y, and, finally, the reeling shaft 19 takes up the continuous paper P.

The printing unit 13 performs printing on the continuous paper P that is supported by the supporting member 14 in a transportation stop state. Specifically, for printing, the printing unit 13 ejects ink while reciprocating in the width direction (for example, the shaft direction X) intersecting with (for example, orthogonal to) the transportation direction Y. That is, the printer 11 performs printing by alternation of the print scan of the printing unit 13 in the width direction and the transportation of the continuous paper P in the transportation direction Y.

An imaging device 26, which captures an image of the continuous paper P, is mounted on the supporting member 14. Specifically, from the back (non-printing surface) of the continuous paper P, the imaging device 26 captures an image of the texture of the continuous paper P. The back of the continuous paper P is the side that is supported by the supporting member 14 and is the opposite of the front (printing surface), which faces the printing unit 13 for printing. "Texture" means the characters of the continuous paper P, including but not limited to the color, lightness, and surface irregularities of the continuous paper P.

The imaging device 26 performs image processing such as template matching on the basis of the data of the captured image to acquire the movement amount of the continuous paper P. The transportation control unit 23 receives the movement amount of the continuous paper P from the imaging device 26, and controls the operation of the transportation motor 21 and the reeling motor 22 on the basis of the movement amount.

Figure 2:
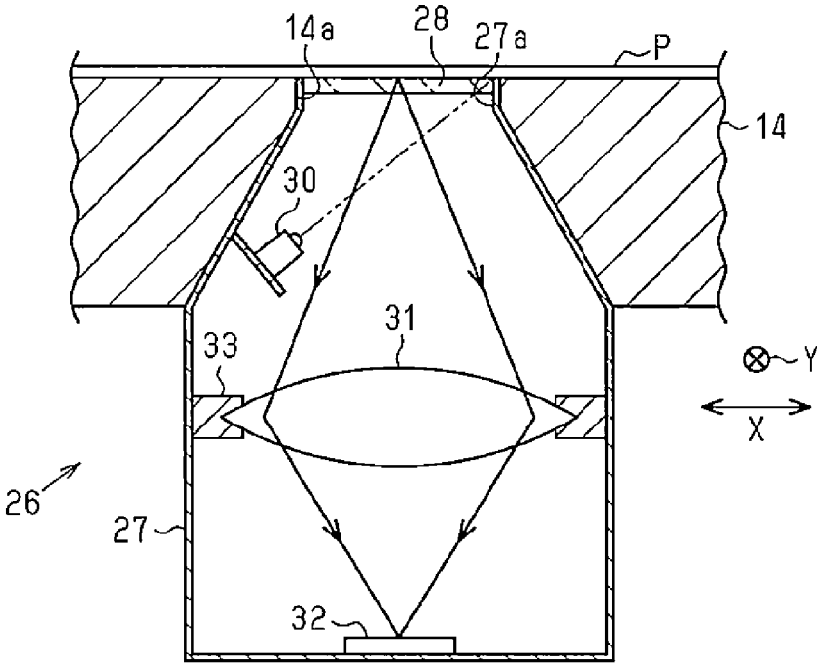
FIG. 2 is a schematic sectional view of an imaging device.

As illustrated in FIG. 2, the imaging device 26 includes a case 27, which is an enclosure with a bottom. The case 27 is fixed to the supporting member 14 by a fixing portion that is not illustrated in the drawings in a state of being partially inserted into a through hole 14*a* from the back (the opposite of the side at which the printing unit 13 is provided). The through hole 14*a* is formed in the supporting member 14. The case 27 has a rectangular light-transmissive detection window 27*a* at the end inserted into the supporting member 14. A light-transmissive glass 28, which is colorless and transparent and allows light to pass through itself, is in the detection window 27*a*. The light-transmissive glass 28 prevents paper powder and dust, etc. from entering the case 27.

A light irradiation unit 30, a condensing lens 31, and an imager 32 are provided in this order inside the case 27 as viewed from the detection window 27*a*. That is, the light irradiation unit 30 is provided between the light-transmissive glass 28 and the condensing lens 31 in such a way as to emit light obliquely toward the light-transmissive glass 28. Therefore, the light emitted by the light irradiation unit 30 impinges on the back of the continuous paper P supported by the supporting member 14 through the light-transmissive glass 28. The light irradiation unit 30 is, for example, a light emitting diode (LED) or a laser diode (LD).

The condensing lens 31 is a lens for gathering the light reflected by the continuous paper P after the emission by the light irradiation unit 30. The condensing lens 31 is held on the case 27 by a holder 33. The imager 32 is an area image sensor such as a CMOS sensor, etc. for detecting the light condensed by the condensing lens 31 in an image-focusing manner.

Figure 3:
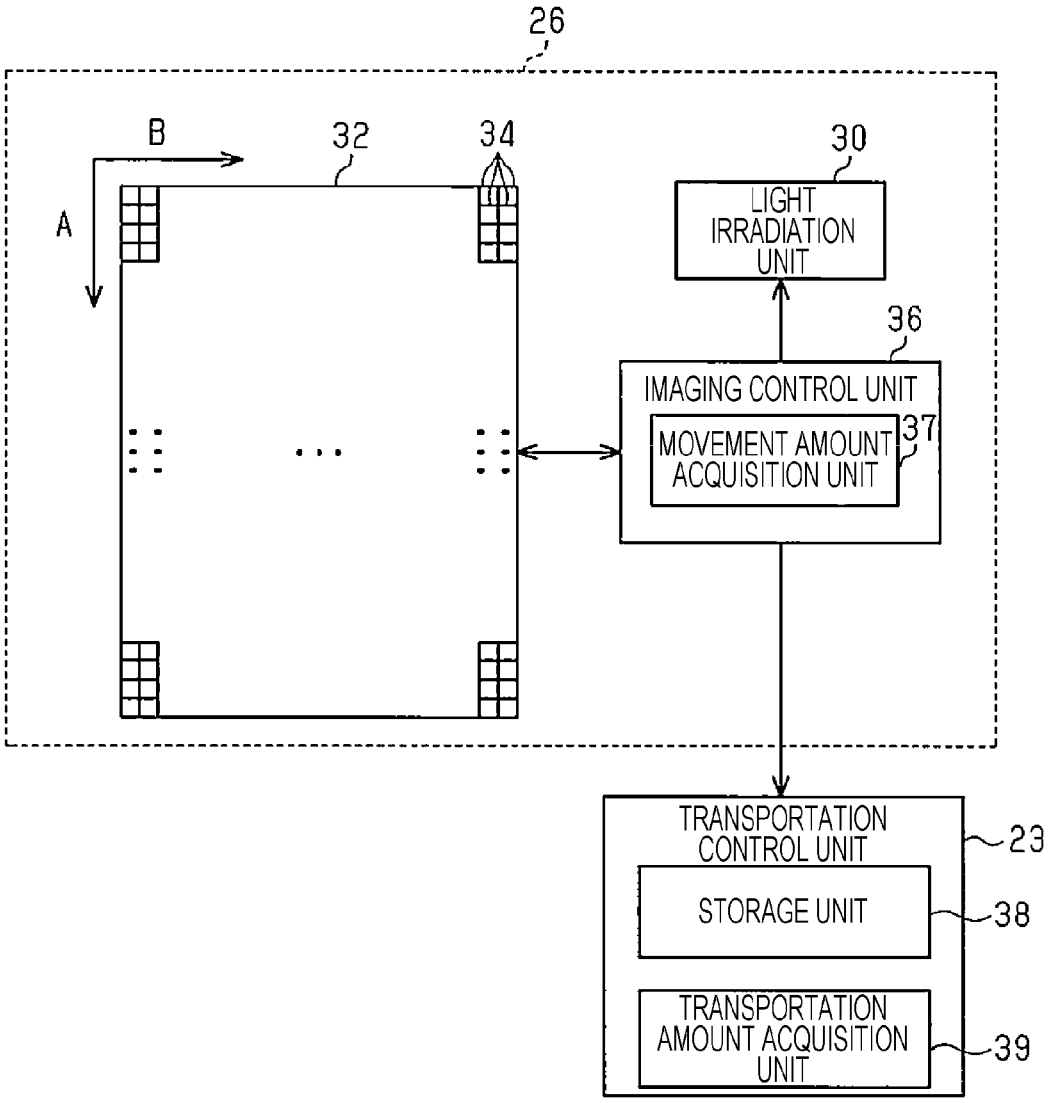
FIG. 3 is a block diagram of the imaging device and a transportation control unit.

The imager 32 is provided with plural photoreceptor elements 34 and captures an image of the continuous paper P transported by the transportation unit 24. As illustrated in FIG. 3, the photoreceptor elements 34 are arranged in a matrix in a first direction A and a second direction B intersecting with (for example, orthogonal to) the first direction A. In the imager 32 of the present embodiment, the number of the photoreceptor elements 34 arranged in the second direction B is different from the number of the photoreceptor elements 34 arranged in the first direction A, meaning that the photoreceptor elements 34 constitute a rectangular array. In the present embodiment, the first direction A is defined as a direction in which a larger number of the photoreceptor elements 34 are arranged in each line (longer side), and the second direction B is defined as a direction in which a smaller number of the photoreceptor elements 34 are arranged in each line (shorter side).

The imaging device 26 includes an imaging control unit 36, which controls the light emission of the light irradiation unit 30 and controls readout from the pixels of the imager 32. The imaging control unit 36 includes a movement amount acquisition unit 37, which acquires the movement amount of the continuous paper P on the basis of the pixel readout from the imager 32. The imaging control unit 36 outputs the acquired movement amount to the transportation control unit 23.

When the continuous paper P is transported in the transportation direction Y, in some cases, skew occurs in a direction (for example, the shaft direction X) intersecting with the transportation direction Y. Therefore, assuming that the movement amount of the continuous paper P is acquired as the vector sum of the movement amount of the continuous paper P in the first direction A and the movement amount of the continuous paper P in the second direction B, the acquired movement amount contains the amount of the skew of the continuous paper P in the shaft direction X.

To avoid this from happening, the imaging device 26 is attached to the supporting member 14 in such a way that the first direction A of the imager 32 coincides with the transportation direction Y of the continuous paper P. In other words, the imaging device 26 is mounted in such a way that the first direction A intersects with (for example, is orthogonal to) the shaft direction X. The imaging control unit 36 outputs the movement amount of the continuous paper P in the first direction A to the transportation control unit 23. In this case, since the first direction A coincides with the transportation direction Y, it is possible to acquire a movement amount with the elimination of the effects of the skew of the continuous paper P by detecting, as the movement amount mentioned here, the amount of the movement of the continuous paper P in the first direction A. However, in some cases, actually, the first direction A does not coincide with the transportation direction Y because of, for example, the tolerance of parts constituting the imaging device 26 or a mounting error when the imaging device 26 and the supporting member 14 are mounted.

To deal with the above possibility, the transportation control unit 23 includes a storage unit 38, which stores a correction value to be used for correcting the movement amount in accordance with the inclination of the first direction A with respect to the transportation direction Y. In addition, the transportation control unit 23 includes a transportation amount acquisition unit 39, which acquires the transportation amount of the continuous paper P in the transportation direction Y by amending the movement amount of the continuous paper P in the first direction A on the basis of the correction value stored in the storage unit 38. That is, the transportation amount acquisition unit 39 acquires the transportation amount of the continuous paper P in the transportation direction Y by amending the movement amount acquired on the basis of the image captured by the imager 32 by the movement amount acquisition unit 37.

Next, the correction value will now be explained. The correction value is a preset value that has been set in advance before printing. Specifically, the correction value has been set on the basis of an image captured by the imaging device 26 through actual transportation of the continuous paper P by a predetermined transportation amount in the transportation direction Y.

Figure 4:
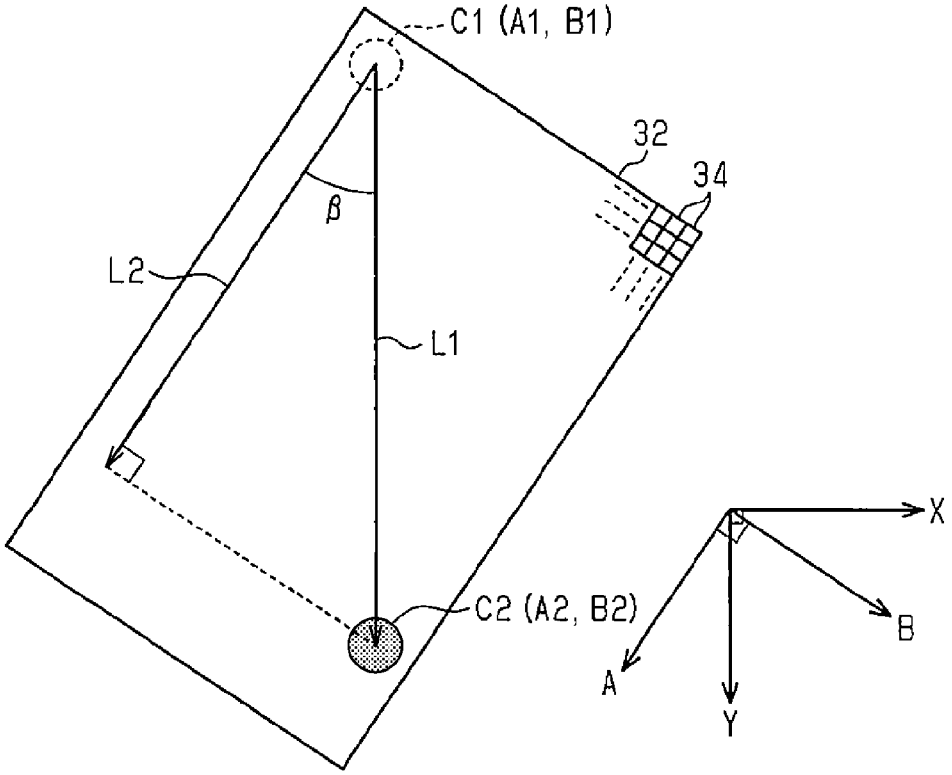
FIG. 4 is a schematic diagram of an imager.

As illustrated in FIG. 4, it is assumed here that the imager 32 is mounted in a state in which the first direction A is inclined with respect to the transportation direction Y by an angle of inclination β. However, in FIG. 4, for the purpose of making it easier to understand the explanation, the angle of inclination β is exaggerated. In a case where the first direction A and the transportation direction Y do not coincide with each other as in this example, meaning intersection with each other, when the continuous paper P is transported by a predetermined transportation amount L1 in the transportation direction Y, a movement amount L2 of the continuous paper P in the first direction A, that is, the movement amount acquired by the movement amount acquisition unit 37, is different from the transportation amount L1.

Specifically, let us consider the following example. When the image capturing of the continuous paper P was performed at a certain point in time, a photoreceptor element 34 that is located at a first position C1, which is indicated by a broken-line circle in the drawing, captured a certain feature of the continuous paper P. Next, when the image capturing of the continuous paper P is performed after the transportation of the continuous paper P by the predetermined transportation amount L1, a photoreceptor element 34 that is located at a second position C2, which is indicated by a solid-line circle in the drawing, now captures this feature of the continuous paper P, that is, the feature that was captured earlier by the photoreceptor element 34 located at the first position C1.

Let us define the coordinate of the first position C1 as (A1, B1), and the coordinate of the second position C2 as (A2, B2). Given this definition, the angle β formed by the transportation direction Y and the first direction A can be expressed by the following formula (1).

$$\beta = \tan^{-1}\frac{B2 - B1}{A2 - A1} \tag{1}$$

Then, the value of 1/cos β is calculated on the basis of the angle β, and the value of 1/cos β is stored into the storage unit 38 as the correction value. Therefore, the correction value is a value that is determined depending on the angle β and changes in accordance with the orientation of the first direction A. In the present embodiment, the orientation of the first direction A is expressed as its inclination with respect to the transportation direction Y, and the first direction A is inclined with respect to the transportation direction Y by the angle β. That is, for example, if the angle β is 0°, the orientation of the first direction A is the same as that of the transportation direction Y, meaning that the first direction A and the transportation direction Y are in parallel with each other.

Next, operation performed when the continuous paper P is transported will now be explained. When the transportation motor 21 and the reeling motor 22 are driven by the transportation control unit 23, the transportation roller 17 and the reeling shaft 19 rotate, and the continuous paper P is transported from the upstream side to the downstream side in the transportation direction Y.

During the transportation operation described above, the imaging control unit 36 causes the light irradiation unit 30 to emit light periodically, and acquires pixel data from each of the photoreceptor elements 34 in accordance with the timing of the light emission. That is, the imaging control unit 36 causes the imager 32 to capture an image of the continuous paper P at certain time intervals, and acquires image data as the data of the aggregate of the pixels from the imager 32. Then, the movement amount acquisition unit 37 acquires the movement amount L2 in the first direction A on the basis of the image captured by the imager 32 (movement amount acquisition step).

Specifically, the imaging control unit 36 causes the light irradiation unit 30 to blink at time intervals shorter than time obtained by dividing the length of the imager 32 in the transportation direction Y by the transportation speed of the continuous paper P. In addition, the imaging control unit 36 acquires image data at the timing of the light emission by the light irradiation unit 30. As a result, it is possible to acquire plural pieces of image data that contain a partial image area overlap. The movement amount acquisition unit 37 compares the plural pieces of image data with one another to extract a common feature of the continuous paper P in these pieces of image data. Then, the movement amount acquisition unit 37 acquires information on how much the common feature of the continuous paper P in these pieces of image data has moved in the first direction A during a period of time between the acquisition of the preceding image data and the acquisition of the current image data, which is the one after the preceding image data.

The imaging control unit 36 outputs the movement amount of the feature of the continuous paper P in the first direction A, that is, the movement amount acquired by the movement amount acquisition unit 37, as the movement amount L2 of the continuous paper P in the first direction A to the transportation control unit 23. At the transportation control unit 23, the transportation amount acquisition unit 39 acquires the transportation amount L1 on the basis of the following formula (2). That is, the transportation amount acquisition unit 39 acquires the transportation amount L1 in the transportation direction Y by amending the movement amount L2 in accordance with the correction value (transportation amount acquisition step).

$$L1 = L2 * \frac{1}{\cos\beta} \tag{2}$$

As expressed in the above formula, for the amendment, the transportation amount acquisition unit 39 multiplies the movement amount L2 of the continuous paper P in the first direction A by the value of 1/cos β pre-stored as the correction value, thereby acquiring the transportation amount L1 of the continuous paper P in the transportation direction Y.

The transportation control unit 23 performs the acquisition of the transportation amount L1 during the transportation of the continuous paper P and controls the operation of the transportation motor 21 and the reeling motor 22 in such a way as to make the total of the acquired transportation amount L1 equal to a target amount.

The first embodiment described above produces the following advantageous effects:

(1) It is possible to acquire the movement amount L2 of the continuous paper P in the first direction A on the basis of the image of the continuous paper P captured by the imager 32. Then, it is possible to acquire the transportation amount L1 of the continuous paper P in the transportation direction Y by amending the movement amount L2 in accordance with the correction value. Therefore, even in a case where the first direction A and the transportation direction Y do not coincide with each other, it is possible to acquire the transportation amount L1 of the transported continuous paper P precisely.

(2) It is possible to set the correction value in accordance with the angle β, which is formed by the first direction A in which the photoreceptor elements 34 are arranged and the transportation direction Y in which the continuous paper P is transported. Then, on the basis of the correction value, it is possible to acquire the transportation amount L1 easily.

(3) The transportation device 12 can transport the continuous paper P on the basis of the transportation amount L1 acquired with high precision. This makes it possible to improve the quality of printing on the continuous paper P transported by the transportation device 12.

Second Embodiment

Next, with reference to the accompanying drawing, a printer 11 according to a second embodiment will now be explained. The difference of the second embodiment from the first embodiment lies in the way of expressing the orientation of the first direction A. Except for this point of difference, the structure of the second embodiment is substantially the same as the structure of the first embodiment. Therefore, the same reference numerals are assigned to the same components, etc., and an explanation of them is not given here.

Figure 5:
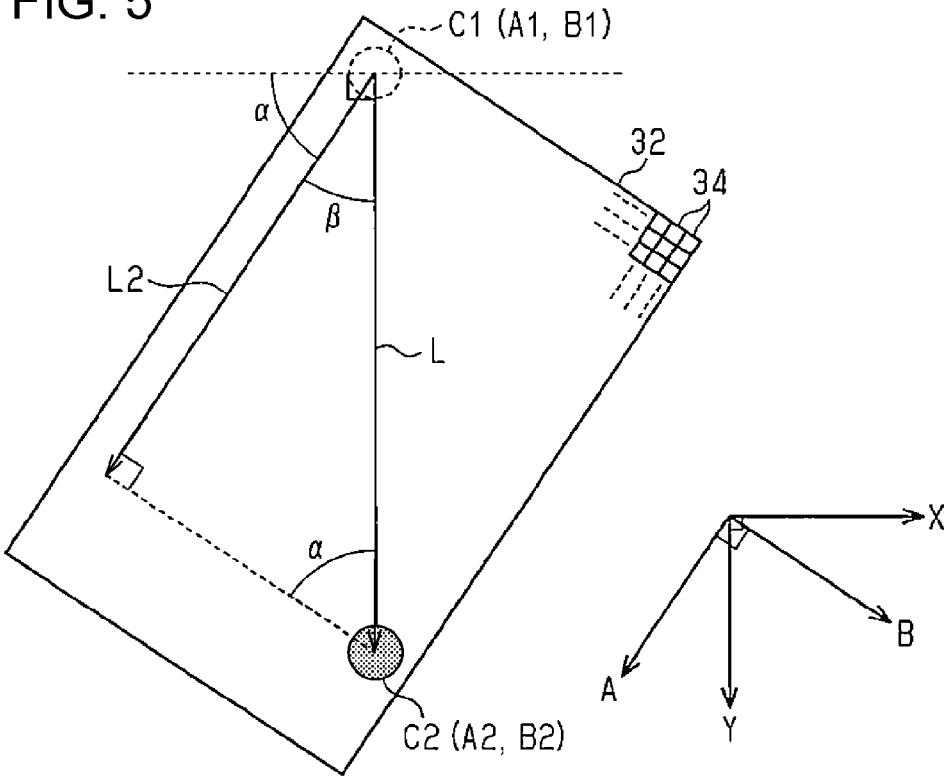
FIG. 5 is a schematic diagram of an imager in a printing apparatus according to a second embodiment.

Let α be an angle formed by the shaft direction X and the first direction A as illustrated in FIG. 5. That is, in a case where the shaft direction X is orthogonal to the transportation direction Y, the angle α can be acquired by subtracting the angle β from 90°. The angle α can be expressed by the following formula (3).

$$\alpha = \tan^{-1}\frac{A2 - A1}{B2 - B1} \tag{3}$$

Specifically, in a case where the correction value is set, the continuous paper P is transported by the predetermined transportation amount L1 in the transportation direction Y as in the first embodiment, and the angle α is determined. Then, the value of 1/sin α is calculated on the basis of the angle α, and the value of 1/sin α is stored into the storage unit 38 as the correction value. This correction value is determined depending on the angle α and changes in accordance with the orientation of the first direction A. In the present embodiment, the orientation of the first direction A is expressed as its inclination with respect to the shaft direction X, and the first direction A is inclined with respect to the shaft direction X by the angle α. That is, for example, if the angle α is 90°, the orientation of the first direction A is the same as that of the transportation direction Y, meaning that the first direction A and the transportation direction Y are in parallel with each other.

Next, operation performed when the continuous paper P is transported will now be explained. The imaging control unit 36 causes the light irradiation unit 30 to emit light periodically for the capturing of an image of the continuous paper P. Then, the movement amount acquisition unit 37 acquires the movement amount L2 in the first direction A on the basis of the image captured by the imager 32 (movement amount acquisition step). The acquired movement amount L2 is outputted to the transportation control unit 23. At the transportation control unit 23, the transportation amount acquisition unit 39 acquires the transportation amount L1 in the transportation direction Y by amending the movement amount L2 in accordance with the correction value on the basis of the following formula (4) (transportation amount acquisition step).

$$L1 = L2 * \frac{1}{\sin\alpha} \tag{4}$$

As expressed in the above formula, for the amendment, the transportation amount acquisition unit 39 multiplies the movement amount L2 of the continuous paper P in the first direction A by the value of 1/sin α pre-stored as the correction value, thereby acquiring the transportation amount L1 of the continuous paper P in the transportation direction Y.

The second embodiment described above produces the following advantageous effect in addition to the advantageous effects (1) to (3) of the first embodiment.

(4) It is possible to set the correction value in accordance with the angle α, which is formed by the first direction A in which the photoreceptor elements 34 are arranged and the shaft direction X of the transportation roller 17. Then, on the basis of the correction value, it is possible to acquire the transportation amount easily.

Third Embodiment

Next, with reference to the accompanying drawing, a printer 11 according to a third embodiment will now be explained. In the third embodiment, the imaging plane of the imaging device 26 is inclined. Therefore, its orientation in the third embodiment is different from that in the first and second embodiments. That is, the imager 32 is provided in parallel with the continuous paper P in the first and second embodiments, whereas the imager 32 is provided not in parallel with the continuous paper P in the third embodiment. Except for this point of difference, the structure of the third embodiment is substantially the same as the structure of the first and second embodiments. Therefore, the same reference numerals are assigned to the same components, etc., and an explanation of them is not given here.

Figure 6:
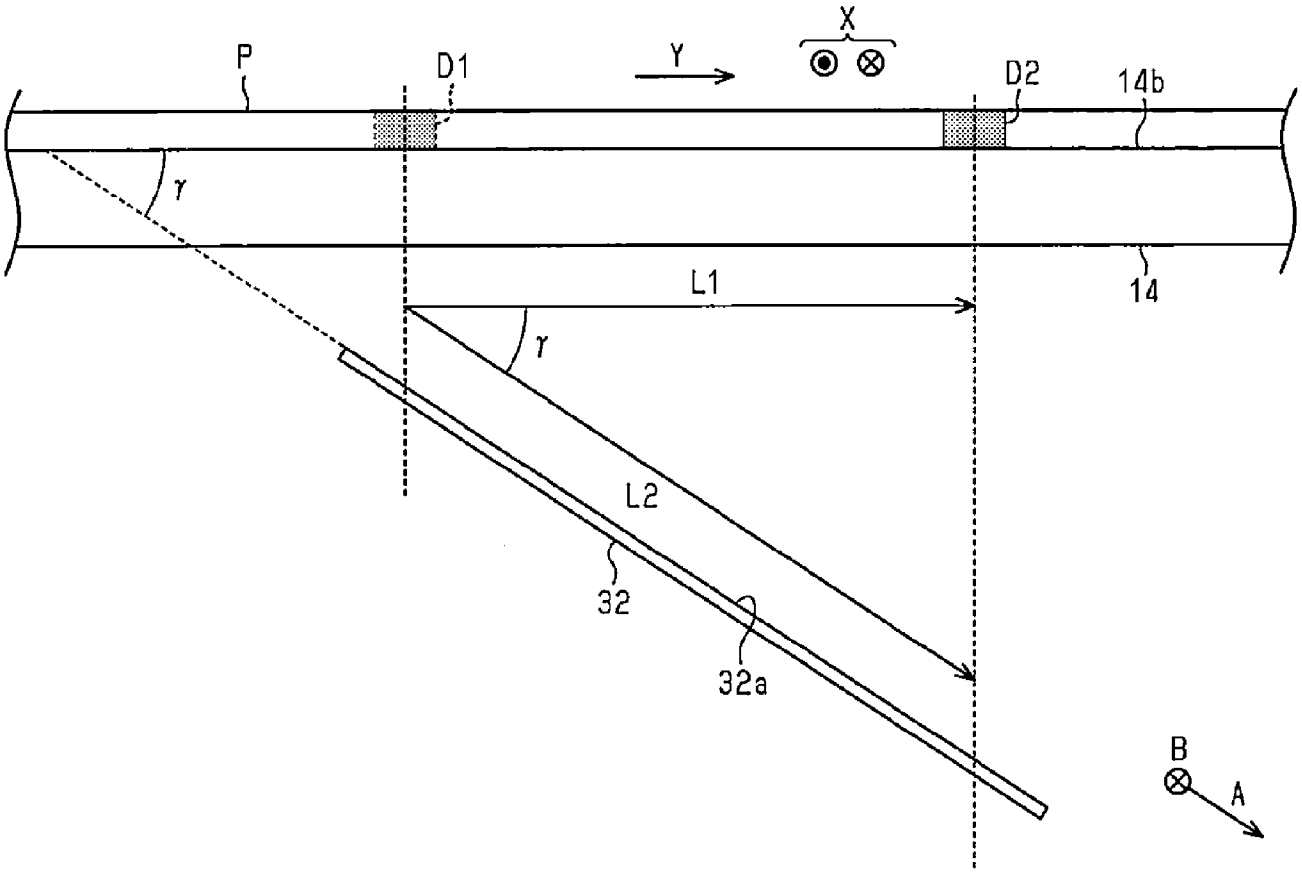
FIG. 6 is a schematic diagram of an imager in a printing apparatus according to a third embodiment.

Let γ be an angle formed by the continuous paper P and the imager 32 as illustrated in FIG. 6. That is, the angle formed by the supporting plane 14*b* of the supporting member 14 and the photoreceptor plane 32*a* of the imager 32 is defined as γ. The supporting plane 14*b*, which supports the continuous paper P, is an example of a first plane. The photoreceptor plane 32*a*, which receives light, is an example of a second plane. The supporting plane 14*b* is a plane that includes the shaft direction X and the transportation direction Y along the transportation path of the continuous paper P. The photoreceptor plane 32*a* is a plane that includes the first direction A and the second direction B. The photoreceptor elements 34 are arranged on the photoreceptor plane 32*a*. However, in FIG. 6, for the purpose of making it easier to understand the explanation, the angle γ is exaggerated, and it is assumed that the shaft direction X and the second direction B coincide with each other.

In a case where the photoreceptor plane 32*a* is not in parallel with the supporting plane 14*b*, the movement amount L2 acquired by the imaging device 26 in the first direction A is different from the transportation amount L1 of the continuous paper P in the transportation direction Y. Specifically, let us assume that a certain feature of the continuous paper P was located at a first position D1, which is indicated by a broken line in FIG. 6, when the image capturing of the continuous paper P was performed at a certain point in time. Let us assume that, next, the feature of the continuous paper P that was captured earlier at the first position D1 is now located at a second position D2, which is indicated by a solid line in FIG. 6, when the image capturing of the continuous paper P is performed after the transportation of the continuous paper P by the predetermined transportation amount L1 in the transportation direction Y. Given these assumptions, the relationship among the angle γ, the predetermined transportation amount L1 in the transportation direction Y, and the movement amount L2 in the first direction A can be expressed by the following formula (5).

$$\cos\gamma = \frac{L1}{L2} \tag{5}$$

That is, it is possible to calculate the value of cos γ by dividing the predetermined transportation amount L1 in the transportation direction Y by the movement amount L2 acquired by the movement amount acquisition unit 37 when the continuous paper P is transported by the transportation amount L1. The value of cos γ is stored into the storage unit 38 as the correction value. This correction value is determined depending on the angle γ and changes in accordance with the orientation of the first direction A. In the present embodiment, the orientation of the first direction A is expressed as its inclination with respect to the supporting plane 14*b*, and the first direction A is inclined with respect to the supporting plane 14*b* by the angle γ. That is, for example, if the angle γ is 0°, the first direction A is oriented in parallel with the supporting plane 14*b*.

Next, operation performed when the continuous paper P is transported will now be explained. The imaging control unit 36 causes the light irradiation unit 30 to emit light periodically for the capturing of an image of the continuous paper P. Then, the movement amount acquisition unit 37 acquires the movement amount L2 in the first direction A on the basis of the image captured by the imager 32 (movement amount acquisition step). The acquired movement amount L2 is outputted to the transportation control unit 23. At the transportation control unit 23, the transportation amount acquisition unit 39 acquires the transportation amount L1 in the transportation direction Y by amending the movement amount L2 in accordance with the correction value on the basis of the following formula (6) (transportation amount acquisition step).

$$L1=L2\cdot\cos\gamma \tag{6}$$

As expressed in the above formula, for the amendment, the transportation amount acquisition unit 39 multiplies the movement amount L2 of the continuous paper P in the first direction A by the value of cos γ pre-stored as the correction value, thereby acquiring the transportation amount L1 of the continuous paper P in the transportation direction Y.

The third embodiment described above produces the following advantageous effect in addition to the advantageous effects (1) to (4) of the first and second embodiments.

(5) It is possible to acquire the transportation amount L1 of the continuous paper P with the use of γ, that is, the angle formed by the supporting plane 14*b*, along which the continuous paper P passes, and the photoreceptor plane 32*a*, on which the photoreceptor elements 34 are arranged. Therefore, even in a case where the photoreceptor plane 32*a* is not in parallel with the supporting plane 14*b*, it is possible to acquire the transportation amount L1 of the transported continuous paper P precisely.

Fourth Embodiment

Next, with reference to the accompanying drawing, a printer 11 according to a fourth embodiment will now be explained. The difference of the fourth embodiment from the first embodiment lies in that the possibility of the occurrence of the positional deviation of the continuous paper P in the shaft direction X due to skew is taken into consideration when the continuous paper P is transported in the transportation direction Y, which is orthogonal to the shaft direction X. Except for this point of difference, the structure of the fourth embodiment is substantially the same as the structure of the first embodiment. Therefore, the same reference numerals are assigned to the same components, etc., and an explanation of them is not given here.

As in the first embodiment, the transportation control unit 23 acquires the angle β on the basis of the captured image of the continuous paper P transported in the transportation direction Y, and puts the angle β into the memory of the storage unit 38. Even in a case where, for example, the positional deviation of the elongated continuous paper P occurs in a direction intersecting with the transportation direction Y during transportation, such deviated transportation does not continue in this direction. That is, the continuous paper P is transported in a meandering manner with changes in the direction of skew depending on the characteristics of the transportation device 12 and the characteristics of the continuous paper P itself. Such skew of the continuous paper P is relatively severe immediately after the setting of the continuous paper P on the transportation device 12. The skew becomes less severe as the transportation of the continuous paper P proceeds.

In view of this tendency, preferably, before the acquisition of the angle β, the continuous paper P should have been transported by a sufficient amount in advance. With the transportation of the continuous paper P in advance, it is possible to acquire the angle β with a reduction in the effects of the skew of the continuous paper P in the shaft direction X.

Figure 7:
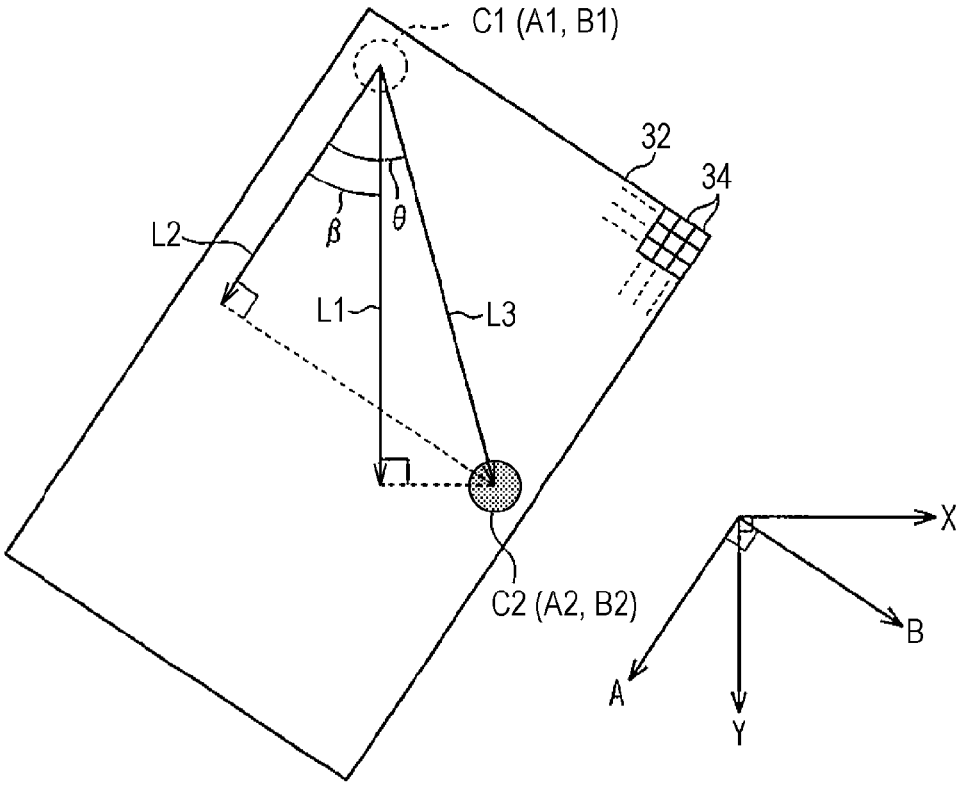
FIG. 7 is a schematic diagram of an imager in a printing apparatus according to a fourth embodiment.

Next, the correction value set while taking the skew of the continuous paper P in the shaft direction X will now be explained. Let us consider the following example. When the image capturing of the continuous paper P was performed at a certain point in time, as illustrated in FIG. 7, a photoreceptor element 34 that is located at a first position C1, which is indicated by a broken-line circle, captured a certain feature of the continuous paper P. Next, when the image capturing of the continuous paper P is performed after the transportation of the continuous paper P, a photoreceptor element 34 that is located at a second position C2, which is indicated by a solid-line circle, now captures this feature of the continuous paper P, that is, the feature that was captured earlier by the photoreceptor element 34 located at the first position C1.

Let us define the coordinate of the first position C1 as (A1, B1), and the coordinate of the second position C2 as (A2, B2). Given this definition, the angle θ formed by the direction of the actual transportation of the continuous paper P and the first direction A can be expressed by the following formula (7).

$$\theta=\tan^{-1}\frac{B2-B1}{A2-A1} \tag{7}$$

Let L3 be the vector sum of the movement amount of the continuous paper P in the first direction A and the movement amount of the continuous paper P in the second direction B. Given this definition, the relationship between the transportation amount L1 in the transportation direction Y and the sum movement amount L3 can be expressed by the following formula (8). In addition, the relationship between the movement amount L2 in the first direction A and the sum movement amount L3 can be expressed by the following formula (9). Therefore, the following formula (10) is derived from the formulas (8) and (9).

$$\cos(\theta-\beta)=\frac{L1}{L3} \tag{8}$$

$$\cos\theta=\frac{L2}{L3} \tag{9}$$

$$L1=L2*\frac{1}{\cos\theta}*\cos(\theta-\beta) \tag{10}$$

The transportation control unit 23 puts cos(θ−β)/cos θ into the memory of the storage unit 38 as the formula for calculating the correction value.

Next, operation performed when the continuous paper P is transported will now be explained. The imaging control unit 36 causes the light irradiation unit 30 to emit light periodically for the capturing of an image of the continuous paper P. Then, the movement amount acquisition unit 37 acquires the movement amount L2 in the first direction A on the basis of the image captured by the imager 32 (movement amount acquisition step). The transportation control unit 23 acquires the angle θ expressed in the formula (7). Then, the acquired movement amount L2 and the acquired angle θ, together with the angle β, which has been acquired in advance, are substituted into the formula (10). As a result of the substitution, the transportation amount L1 in the transportation direction Y is acquired (transportation amount acquisition step).

That is, for the amendment, the transportation amount acquisition unit 39 multiplies the movement amount L2 of the continuous paper P in the first direction A by the value of cos(θ−β)/cos θ, which is the correction value, thereby acquiring the transportation amount L1 of the continuous paper P in the transportation direction Y.

The fourth embodiment described above produces the following advantageous effect in addition to the advantageous effects (1) to (5) of the first, second, and third embodiments.

(6) Even in a case of the skew of the continuous paper P in a direction intersecting with the transportation direction Y, it is possible to acquire the transportation amount L1 of the continuous paper P in the transportation direction Y precisely.

The foregoing embodiments may be modified as follows.

In the first embodiment described earlier, the value of 1/cos β, which is the correction value, may be set as follows: the continuous paper P is transported by the predetermined transportation amount L1; the correction value is set on the basis of the movement amount L2 of the continuous paper P acquired by the movement amount acquisition unit 37 at this time in the first direction A and on the basis of the predetermined transportation amount L1 in the transportation direction Y. Specifically, as illustrated in FIG. 4, the relationship among the angle β, the predetermined transportation amount L1 in the transportation direction Y, and the movement amount L2 in the first direction A can be expressed by the following formula (11). The following formula (12) is derived from the formula (11).

$$\cos\beta = \frac{L2}{L1} \tag{11}$$

$$\frac{1}{\cos\beta} = \frac{L1}{L2} \tag{12}$$

Therefore, the value of 1/cos β may be calculated by dividing the predetermined transportation amount L1 by the movement amount L2 acquired by the movement amount acquisition unit 37, and the value of 1/cos β calculated in this way may be stored into the storage unit 38 as the correction value.

In the second embodiment described earlier, the value of 1/sin α, which is the correction value, may be set as follows: the continuous paper P is transported by the predetermined transportation amount L1; the correction value is set on the basis of the movement amount L2 of the continuous paper P acquired by the movement amount acquisition unit 37 at this time in the first direction A and on the basis of the predetermined transportation amount L1 in the transportation direction Y. Specifically, as illustrated in FIG. 5, the relationship among the angle α, the predetermined transportation amount L1 in the transportation direction Y, and the movement amount L2 in the first direction A can be expressed by the following formula (13). The following formula (14) is derived from the formula (13).

$$\sin\alpha = \frac{L2}{L1} \tag{13}$$

$$\frac{1}{\sin\alpha} = \frac{L1}{L2} \tag{14}$$

Therefore, the value of 1/sin α may be calculated by dividing the predetermined transportation amount L1 by the movement amount L2 acquired by the movement amount acquisition unit 37, and the value of 1/sin α calculated in this way may be stored into the storage unit 38 as the correction value.

The third embodiment described earlier may be combined with the first or second embodiment described earlier, or with the fourth embodiment described above. That is, for example, the transportation amount L1 may be acquired on the basis of the following formula (15), (16), or (17).

$$L1 = L2 * \frac{1}{\cos\beta} * \cos\gamma \tag{15}$$

$$L1 = L2 * \frac{1}{\sin\alpha} * \cos\gamma \tag{16}$$

$$L1 = L2 * \frac{1}{\cos\theta} * \cos(\theta - \beta) * \cos\gamma \tag{17}$$

It is possible to calculate cos γ/cos β and cos γ/sin α by dividing the predetermined transportation amount L1 by the movement amount L2 acquired by the movement amount acquisition unit 37 when the continuous paper P is transported by the predetermined transportation amount L1. That is, the value calculated by dividing the predetermined transportation amount L1 by the movement amount L2 in the first direction A may be stored into the storage unit 38 as the correction value of cos γ/cos β or cos γ/sin α. Then, the transportation amount acquisition unit 39 may calculate the transportation amount L1 by multiplying the movement amount L2 by the correction value.

In the second and third embodiments described earlier, the skew of the continuous paper P may be taken into consideration as in the fourth embodiment.

In each of the foregoing embodiments, the relationship between the correction value and the angle may be pre-stored in the form of a table in the storage unit 38, and the correction value may be specified by inputting an angle. That is, for example, a table that contains the value of 1/cos β and the angle β in association with each other may be pre-stored in the storage unit 38.

In each of the foregoing embodiments, the predetermined transportation amount, by which the continuous paper P is transported when the correction value is set, may be greater than the length of the imager 32 in the transportation direction Y. That is, the imaging control unit 36 acquires image data by capturing an image of the continuous paper P more than once, and, on the basis of each piece of the image data, the movement amount of the continuous paper P in the first direction A during the transportation of the continuous paper P by the predetermined transportation amount is acquired. Then, the correction value may be set on the basis of the predetermined transportation amount and the movement amount. That is, the correction value may be set by dividing the predetermined transportation amount by the transportation amount. The angle α or β may be calculated from the coordinate indicative of the transportation amount of the continuous paper P when the continuous paper P is transported by the predetermined transportation amount. By increasing the predetermined transportation amount, it is possible to reduce the impact of an error at the time of the acquisition of the movement amount L2 by the movement amount acquisition unit 37.

In each of the foregoing embodiments, the supporting plane 14*b* may be a discontinuous plane; a plane that includes a supporting portion that is in contact with the continuous paper P and supports the continuous paper P may be adopted as the supporting plane 14*b*. That is, a plane along which the continuous paper P passes suffices as the supporting plane 14*b*. The surface constituted by the first plane is not limited to be flat. It may be curved. In a case where the first plane (first surface) is curved, the angle formed by the first direction A and this curved surface at the region where an image is captured by the imager 32 can be taken as γ.

In each of the foregoing embodiments, the shaft direction X of the transportation roller 17 may intersect with the width direction of the continuous paper P. The orthogonality of the first direction A and the second direction B to each other is not necessarily required. The orthogonality of the shaft direction X and the transportation direction Y to each other is not necessarily required.

In each of the foregoing embodiments, the imager 32 may have a square array shape or a diamond array shape, in which the number of the photoreceptor elements 34 arranged in the second direction B is the same as the number of the photoreceptor elements 34 arranged in the first direction A. Alternatively, the imager 32 may have a parallelogram array shape or a trapezoid array shape. In the imager 32, the first direction A may be defined as a direction in which a smaller number of the photoreceptor elements 34 are arranged in each line.

In each of the foregoing embodiments, the control of the imaging control unit 36 may be modified for capturing an image of the continuous paper P irrespective of the transportation of the continuous paper P. That is, for example, the imaging control unit 36 may cause the imager 32 to capture an image of the continuous paper P also during printing, with the transportation of the continuous paper P stopped. The imaging control unit 36 may cause the imager 32 to capture an image of the continuous paper P during the transportation of the continuous paper P only.

In each of the foregoing embodiments, the transportation unit may have a belt structure for transporting the continuous paper P. Specifically, for example, it may have the following structure. A driving roller and a driven roller are provided substantially in parallel with each other. An endless belt for transportation is stretched between the driving roller and the driven roller. The transportation belt turns when the driving roller rotates. The continuous paper P is transported due to the turning of the transportation belt.

In each of the foregoing embodiments, the imaging device 26 may capture an image of the front of the continuous paper P. Regarding the position of the imaging device 26, it does not necessarily have to be mounted on the supporting member 14. The imaging device 26 may be provided at any position as long as it can capture an image of the continuous paper P.

In each of the foregoing embodiments, plural transportation rollers 17 and plural relay rollers 18 may be provided. In a case where plural transportation rollers 17 are provided, any one of them may serve as the driving roller. Preferably, among the plural transportation rollers 17, the one that is the nearest to the imaging device 26 should be the driving roller.

In each of the foregoing embodiments, the transportation device 12 may include driven rollers paired with the transportation roller 17 and the relay roller 18 respectively. Specifically, for example, the transportation roller 17 may be rotated to transport the continuous paper P in a state in which the continuous paper P is pinched between the transportation roller 17 and the driven roller. A motor that causes the unreeling shaft 16 to rotate and a motor that causes the relay roller 18 to rotate may be provided.

In each of the foregoing embodiments, the movement amount acquisition unit 37 may be a component of the transportation control unit 23. Specifically, the imaging device 26 may output captured pixel data or captured image data to the transportation control unit 23, and the movement amount L2, and the transportation amount L1 based on the movement amount L2, may be acquired at the transportation control unit 23.

In each of the foregoing embodiments, the movement amount acquisition unit 37 may acquire the sum movement amount L3 by calculating the vector sum of the movement amount in the first direction A and the movement amount in the second direction B. Then, the sum movement amount L3 may be compared with the transportation amount L1 calculated by multiplying the movement amount L2 by the correction value, thereby detecting the behavior of the continuous paper P in the shaft direction X. Specifically, if the sum movement amount L3 is equal to the transportation amount L1 ($\beta=\theta$), it means that the continuous paper P is transported in the transportation direction Y without any movement in the shaft direction X. If the sum movement amount L3 is not equal to the transportation amount L1 ($\beta\neq\theta$), it means some movement of the continuous paper P in the shaft direction X. The transportation of the continuous paper P may be controlled on the basis of the detected behavior.

In each of the foregoing embodiments, the transportation control unit 23 may acquire a total transportation amount, wherein transportation during a period of time from printing by the printing unit 13 to the next printing is counted each as one. Then, transportation to be performed the next time may be controlled on the basis of the total transportation amount.

The medium may be a sheet of paper. The medium may be paper, resin, metal, cloth, ceramic, rubber, or a natural material (wood or stone, etc.), etc., or a combination of any of them. The medium may be a board, a sheet, a film, or a foil, etc. with a certain significant thickness. The medium may have any shape, for example, a rectangular shape or a round shape. Specifically, for example, the medium may be a paper-and-resin combination film (paper impregnated with resin, paper coated with resin, etc.), a paper-and-metal combination film (laminate film, etc.), woven fabric, nonwoven fabric, a disc, or a circuit substrate, etc. The transportation device 12 is not limited to a transportation device in the printer 11. The transportation device 12 may transport any of these various media.

An apparatus that prints characters and/or an image such as a picture or a photo by ejecting liquid such as ink or fluid such as toner onto a medium can be used as the printer 11. For example, the printing apparatus may be a serial printer, a lateral printer, a line printer, or a page printer. The printing apparatus may be an offset printer or a textile printer, etc. It is sufficient as long as the printing apparatus has at least a print function of performing printing on a medium. The printing apparatus may be a multifunction printer that has other functions in addition to a print function. The target of the printing apparatus is not limited to a two-dimensional medium. That is, the printing apparatus may perform printing on a medium that has a three-dimensional curved surface.

The entire disclosure of Japanese Patent Application No. 2015-105429, filed May 25, 2015 is expressly incorporated by reference herein.

What is claimed is:

1. A transportation apparatus, comprising:

a transportation section that transports a medium in a transportation direction intersecting with a shaft direction of a driving roller by operating the driving roller;

an imaging section that includes a plurality of light-receiving elements and captures an image of the medium transported by the transportation section, the light-receiving elements being arranged in a first direction and a second direction, the first direction intersecting with the shaft direction, the second direction intersecting with the first direction; and a transportation amount acquisition section that acquires a transportation amount of the medium in the transportation direction on the basis of the image captured by the imaging section, wherein the transportation amount acquisition section acquires the transportation amount of the medium by correcting a movement amount of the medium in the first direction with a correction value that changes in accordance with orientation of the first direction, wherein the correction value is $1/\cos \beta$ when an angle formed by the transportation direction and the first direction is defined as $\beta$, and wherein the transportation amount acquisition section acquires, as the transportation amount of the medium, an amount obtained by multiplying the movement amount of the medium in the first direction by the correction value.

2. A printing apparatus, comprising:

the transportation apparatus according to claim 1; and a printing section that performs printing on the medium transported by the transportation apparatus.

3. A transportation apparatus, comprising:

a transportation section that transports a medium in a transportation direction intersecting with a shaft direction of a driving roller by operating the driving roller;

an imaging section that includes a plurality of light-receiving elements and captures an image of the medium transported by the transportation section, the light-receiving elements being arranged in a first direction and a second direction, the first direction intersecting with the shaft direction, the second direction intersecting with the first direction; and a transportation amount acquisition section that acquires a transportation amount of the medium in the transportation direction on the basis of the image captured by the imaging section, wherein the transportation amount acquisition section acquires the transportation amount of the medium by correcting a movement amount of the medium in the first direction with a correction value that changes in accordance with orientation of the first direction, wherein the correction value is $1/\sin \alpha$ when an angle formed by the shaft direction and the first direction is defined as $\alpha$, and;

wherein the transportation amount acquisition section acquires, as the transportation amount of the medium, an amount obtained by multiplying the movement amount of the medium in the first direction by the correction value.

4. A printing apparatus, comprising:

the transportation apparatus according to claim 3; and a printing section that performs printing on the medium transported by the transportation apparatus.

5. A transportation apparatus, comprising:

a transportation section that transports a medium in a transportation direction intersecting with a shaft direction of a driving roller by operating the driving roller;

an imaging section that includes a plurality of light-receiving elements and captures an image of the medium transported by the transportation section, the light-receiving elements being arranged in a first direction and a second direction, the first direction intersecting with the shaft direction, the second direction intersecting with the first direction; and a transportation amount acquisition section that acquires a transportation amount of the medium in the transportation direction on the basis of the image captured by the imaging section, wherein the transportation amount acquisition section acquires the transportation amount of the medium by correcting a movement amount of the medium in the first direction with a correction value that changes in accordance with orientation of the first direction, wherein, when an angle formed by a first plane that includes the shaft direction and the transportation direction and a second plane that includes the first direction and the second direction is defined as $\gamma$, the transportation amount acquisition section acquires, as the transportation amount of the medium, an amount obtained by multiplying the movement amount of the medium in the first direction by $\cos \gamma$.

6. A printing apparatus, comprising:

the transportation apparatus according to claim 5; and a printing section that performs printing on the medium transported by the transportation apparatus.

7. A transportation amount acquisition method for a transportation apparatus that includes a transportation section and an imaging section, the transportation section transporting a medium in a transportation direction intersecting with a shaft direction of a driving roller by operating the driving roller, the imaging section including a plurality of light-receiving elements and capturing an image of the medium transported by the transportation section, the light-receiving elements being arranged in a first direction and a second direction, the first direction intersecting with the shaft direction, the second direction intersecting with the first direction, the method comprising:

movement amount acquisition, in which a movement amount of the medium in the first direction is acquired on the basis of the image captured by the imaging section; and transportation amount acquisition, in which a transportation amount of the medium in the transportation direction is acquired by correcting the movement amount with a correction value that changes in accordance with orientation of the first direction, wherein, when an angle formed by a first plane that includes the shaft direction and the transportation direction and a second plane that includes the first direction and the second direction is defined as $\gamma$, the transportation amount acquisition section acquires, as the transportation amount of the medium, an amount obtained by multiplying the movement amount of the medium in the first direction by cos γ.

* * * * *